US005732621A

United States Patent [19]

Hartmann et al.

[11] Patent Number: 5,732,621

[45] Date of Patent: Mar. 31, 1998

[54] FILTER SLEEVE FOR A DRAIN ELEMENT FOR PRESSES TO REMOVE LIQUIDS FROM SOLIDS

[75] Inventors: Eduard Hartmann, Schneisingen; Ruedi Jossi, Balterswil, both of Switzerland

[73] Assignee: Bucher-Guyer AG, Niederweningen, Switzerland

[21] Appl. No.: 583,053

[22] PCT Filed: May 9, 1995

[86] PCT No.: PCT/CH95/00107

§ 371 Date: Jan. 19, 1996

§ 102(e) Date: Jan. 19, 1996

[87] PCT Pub. No.: WO95/32090

PCT Pub. Date: Nov. 30, 1995

[30] Foreign Application Priority Data

May 19, 1994 [CH] Switzerland ..... 01 553/94

[51] Int. Cl.[6] ..... B30B 9/06

[52] U.S. Cl. ..... 100/107; 100/125; 210/232; 210/450; 210/461; 210/462; 210/463; 210/486; 210/495; 210/499

[58] Field of Search ..... 210/461, 483, 210/486, 495, 497.01, 499, 232, 323.1, 323.2, 350, 457, 462, 463, 450; 100/107, 122, 123, 124, 125; 55/378, 507

[56] References Cited

U.S. PATENT DOCUMENTS

| | | | |
|---|---|---|---|
| 4,601,735 | 7/1986 | Morton, Jr. | 55/378 |
| 5,130,022 | 7/1992 | Chara . | |

FOREIGN PATENT DOCUMENTS

| | | | |
|---|---|---|---|
| 414172 | 2/1991 | European Pat. Off. . | |
| 2407731 | 7/1979 | France | 210/483 |
| 4321384 | 9/1994 | Germany . | |
| 413599 | 12/1966 | Switzerland . | |
| 966235 | 8/1964 | United Kingdom | 55/378 |
| 1016643 | 1/1966 | United Kingdom . | |

*Primary Examiner*—Matthew O. Savage
*Attorney, Agent, or Firm*—Burns, Doane, Swecker & Mathis, L.L.P.

[57] ABSTRACT

A filter sleeve (26) surrounds a rod-shaped, flexible drain core with flow paths for removing a pressed-out liquid from the pressing chamber of a press. For mounting one or both ends of the filter sleeve (26) and the drain core on the press, a rubber or elastically deformable shaped element (29) with a ring-like bead (22) is firmly connected with the filter sleeve (26) at its end. The shaped element (29) inseparably penetrates the fabric of the filter sleeve (26) because of an elastomer coating, and the bead (22) is automatically positioned in a groove (24) of a support body (23) because of its previous stretching.

13 Claims, 6 Drawing Sheets

FILTER SLEEVE FOR A DRAIN ELEMENT FOR PRESSES TO REMOVE LIQUIDS FROM SOLIDS

The invention relates to a filter sleeve for a drain element for presses to remove liquids from solids, in particular for fruit presses, wherein the drain element comprises a rod-shaped, flexible drain core with flow paths for removing the pressed-out liquid from the pressing chamber of the press and a liquid-permeable filter sleeve enclosing the drain core, wherein at least one end of the drain element is fastened on a juice collecting plate, pressure plate or on the pressing surface of the press.

BACKGROUND

FIG. 1 shows a longitudinal section through the known fastening of a drain element in a fruit press. A plurality of drain elements 3 are disposed in a pressing chamber 2, bordered by respectively one pressure plate 1, of a known fruit press, not shown.

A drain element 3 essentially consists of an elastic drain core 4, through whose grooves 5, located on its exterior, the liquid is taken out of the pressing chamber 2 during the pressing process, as shown by the section A—A, and of a sock-shaped filter 6 for the separation of liquids from solids stretched over it. The drain core 4 and the filter 6 are respectively fastened on a core holder 7 at the ends of the drain element. In this case the filter is brought over an elastic cuff 8 and is fixed in place by means of an O-ring 9. A disk 10 is used to support the cuff 8 against a transverse pin 11, which is pushed laterally into bores of the drain core 4 and the core holder 7 and in this way assures the axial and radial fixation of the two components 4 and 7 in respect to each other.

The core holder 7 is connected with the pressure plate 1 by means of a spacer bushing 12 and a securing ring 13. In the process a cam 14 of the securing ring 13, which engages a groove of the core holder 7 through a slit in the spacer bushing 12, together with a collar 17 of the spacer bushing 12 located behind the pressure plate 1, provides the security against axial displacement.

As can be seen in FIG. 1, the filter 6 is held in the spacer bushing 12 by being clamped between the core holder 7, the cuff 8 and the O-ring 9. At least the cuff 8 is made of an elastically deformable material, preferably of an elastomer. In this known embodiment, the drain filters 6 are produced by means of a knitting process and, to prevent runs, are closed by sewing or cut by heat at the ends close to the disk 10, so that the stitches are slightly melted to each other.

This type of construction has the following disadvantages:

The assembly of the filter element 6 with the complete drain element 3 is highly labor-intensive. The filter 6 is drawn over the cuff 8 and must be correctly placed in the longitudinal direction. Then the O-ring 9 is pushed over it and must be clamped, together with the drain core 4, in the core holder 7. As a rule, the following assembly errors occur in the course of this: —formation of runs because of too strong a pull—wrong placement in the longitudinal direction—the O-ring is displaced during the insertion—use of lubricants, although this is not permissible. These errors can result in an inadequate fastening of the filter 6 on the connecting element. As a consequence, the filter 6 is pulled out from under the O-ring 9 during the operation and the working of the press is hampered.

A problem also occurs during the disassembly of a filter 6 which is worn in the course of normal operation, because the O-ring 9 in some cases is seated very firmly and in this way makes disassembly more difficult.

SUMMARY OF THE INVENTION

It is the object of the invention to prevent the recited disadvantages by means of a filter sleeve of the type mentioned at the outset.

This object is attained in accordance with the invention by at least one ring-like bead which is deformable in a rubber-elastic manner and is firmly fixed on the filter sleeve on at least one end.

In the process it has been shown to be particularly advantageous if for fastening with the drain element on the press, the ring-like bead permits the push of the respective end of the filter sleeve through an opening whose diameter is less than or equal to the exterior diameter of the filter sleeve in its form where it is fastened on the press. Assembly is particularly simple if the circumference of the ring-like bead and the filter sleeve can be increased by stretching and if, following such stretching and after the bead and the filter sleeve have been pulled on a support body of a corresponding diameter, the bead automatically moves into an exterior groove of the support body because of its previous stretching. Further advantageous embodiments are characterized in the claims.

BRIEF DESCRIPTION OF THE DRAWINGS

The invention will be explained in detail in the following description and in the drawings, which represent exemplary embodiments. In the drawings.

DETAILED DESCRIPTION OF THE INVENTION

Figure 1:
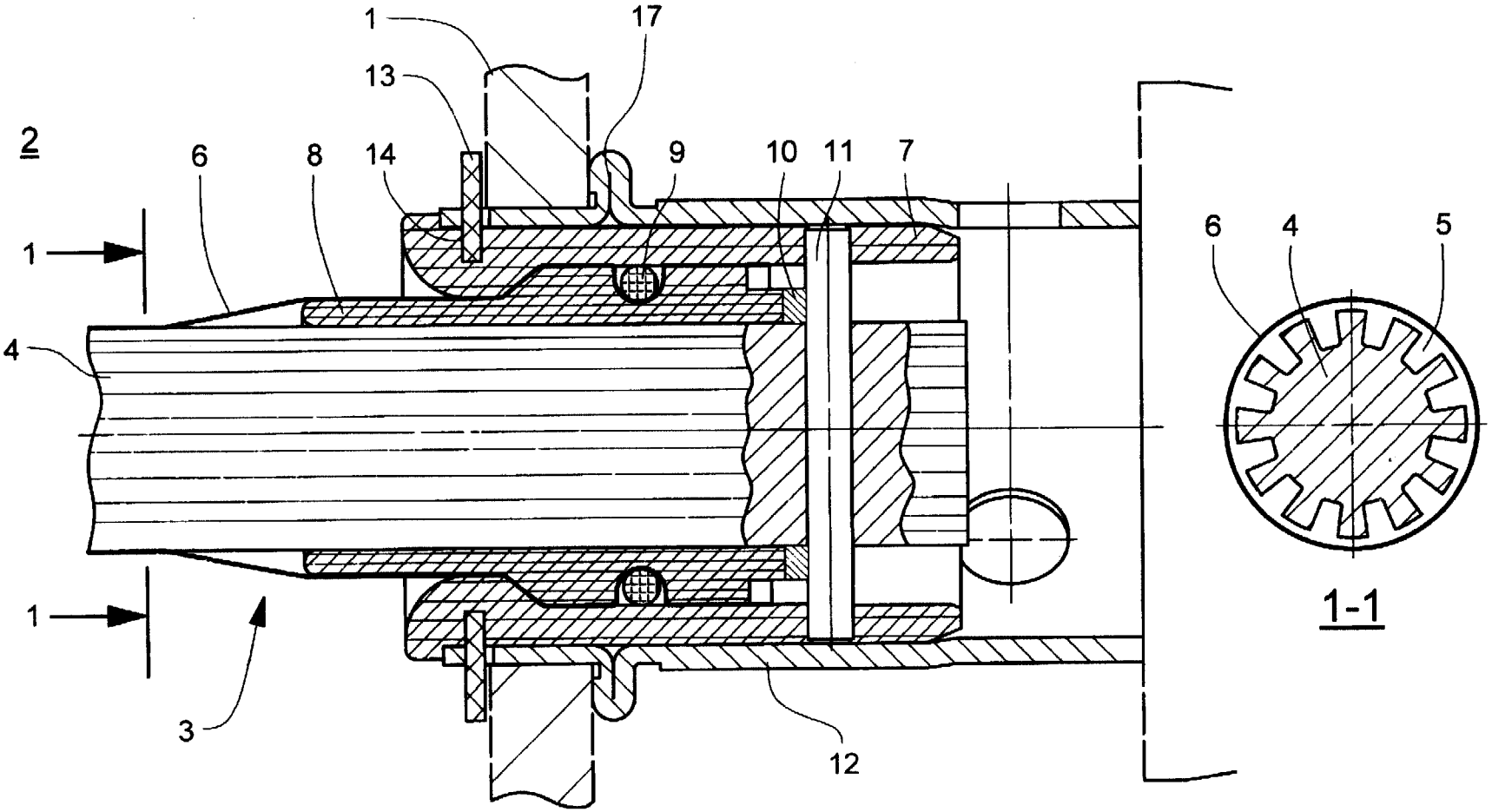
FIG. 1 is a section through a known fastening of a drain element on the pressure plate of a fruit press.
Figure 2:
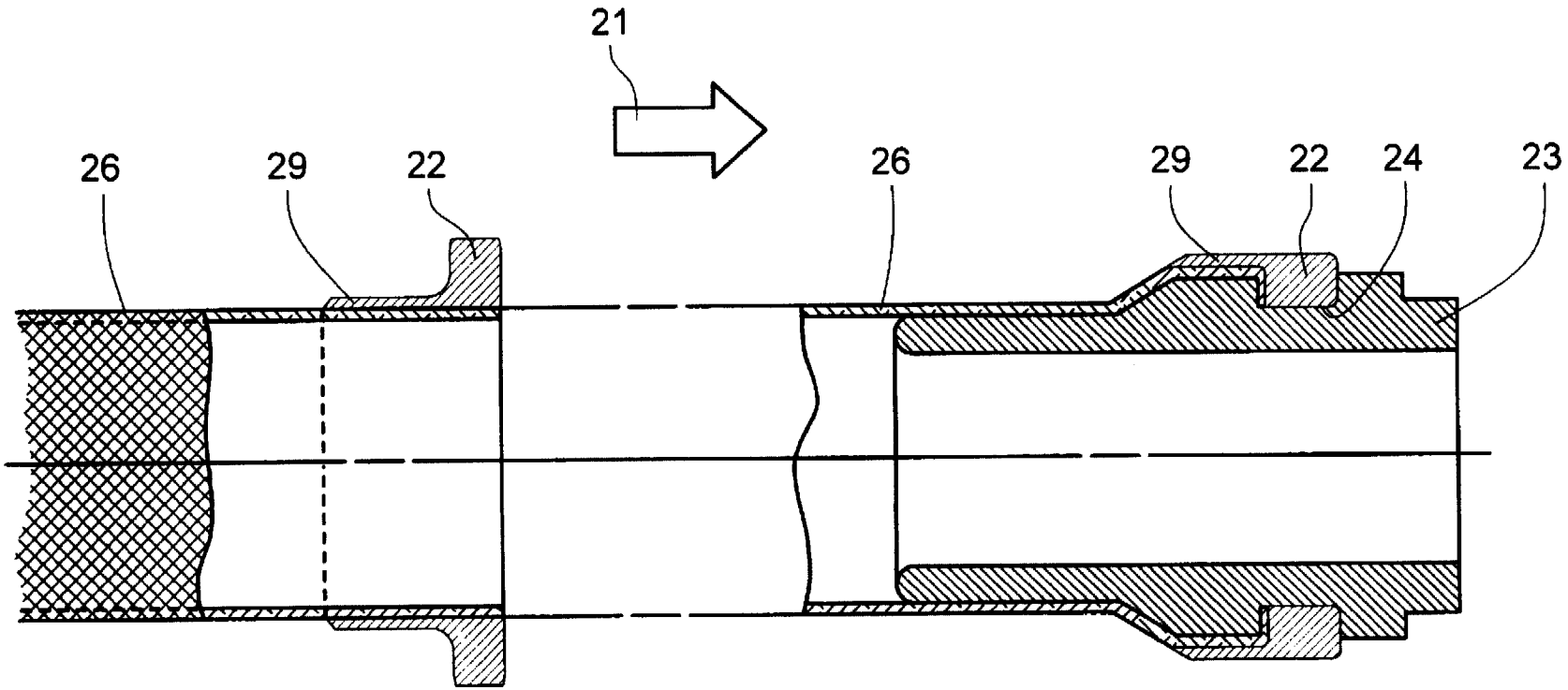
FIG. 2 is a section through a filter sleeve in accordance with the invention and an associated support body to explain the assembly on the pressure plate of a fruit press.

A filter sleeve 26 is shown on the left in FIG. 2, which is similar to the type already shown and explained in FIG. 1. Due to production by means of a knitting process, the circumference and diameter of the filter sleeve 26 can be increased by stretching. An elastic shaped element 29 consisting of a plastic material is attached by casting to the end of the unstretched filter sleeve 26. In the course of attachment by casting of this shaped element 29, the plastic material penetrates the mesh of the fabric of the filter sleeve 26 and in this way makes a solid connection of both elements possible. The cast-on shaped element 29 has a ring-shaped bead 22, whose exterior diameter is greater than the exterior diameter of the filter sleeve 26.

The arrow 21 indicates that on the right side in FIG. 2 the filter sleeve 26 has been pulled on a cuff 23 as the support body. In the course of this process the filter sleeve 26 and the shaped element 29 are elastically stretched. This has as a result that, because of its inherent tension, the bead 22 automatically springs into a groove 24 of the cuff 23 and in this way brings about a correct axial positioning of the filter sleeve 26. This pulling- on process can be manually performed very easily. Molding the shaped element from the outside on the unstretched filter sleeve 26 can also be easily performed since no interior contours must be attached.

Figure 3:
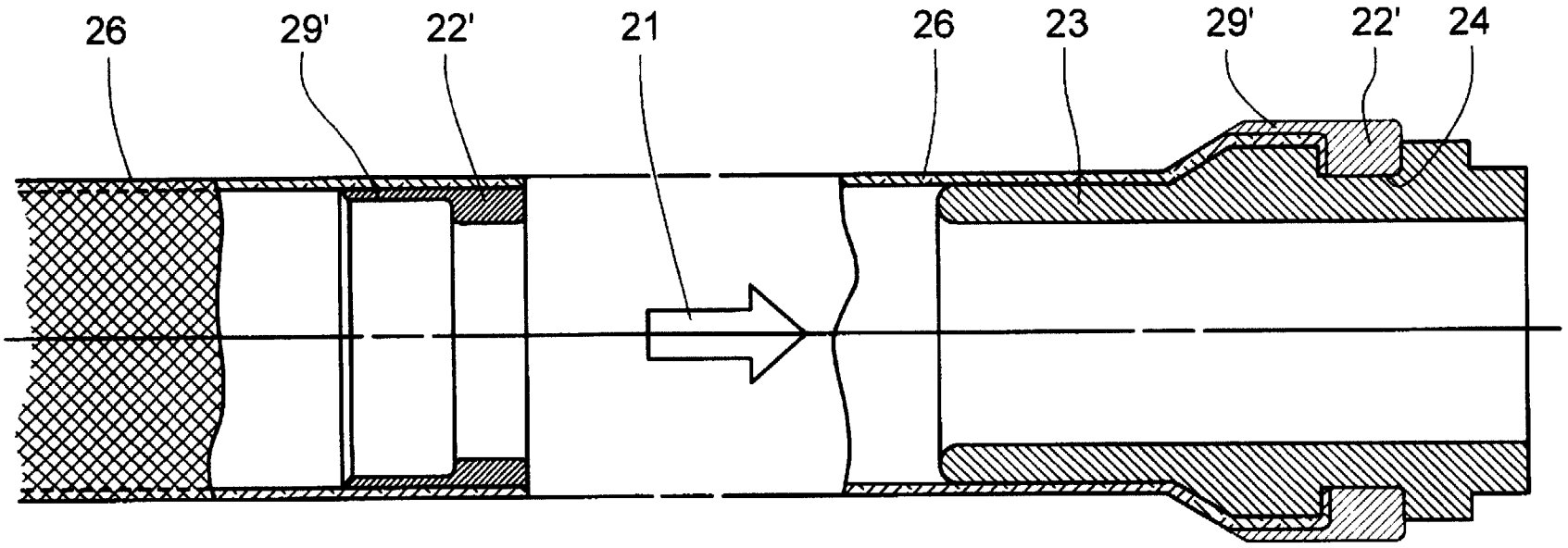
FIG. 3 is a section through another filter sleeve in accordance with the invention and an associated support body to explain the assembly on the pressure plate of a fruit press.

If interior contours are permissible, it is also possible to attach a shaped element 29' on the inside of the filter sleeve 26 such as is shown in FIG. 3. In this case a bead 22' is already in its end position prior to being pulled on the cuff 23 indicated by the arrow 21, following the stretching for assembly it easily falls into the groove 24.

Figure 4:
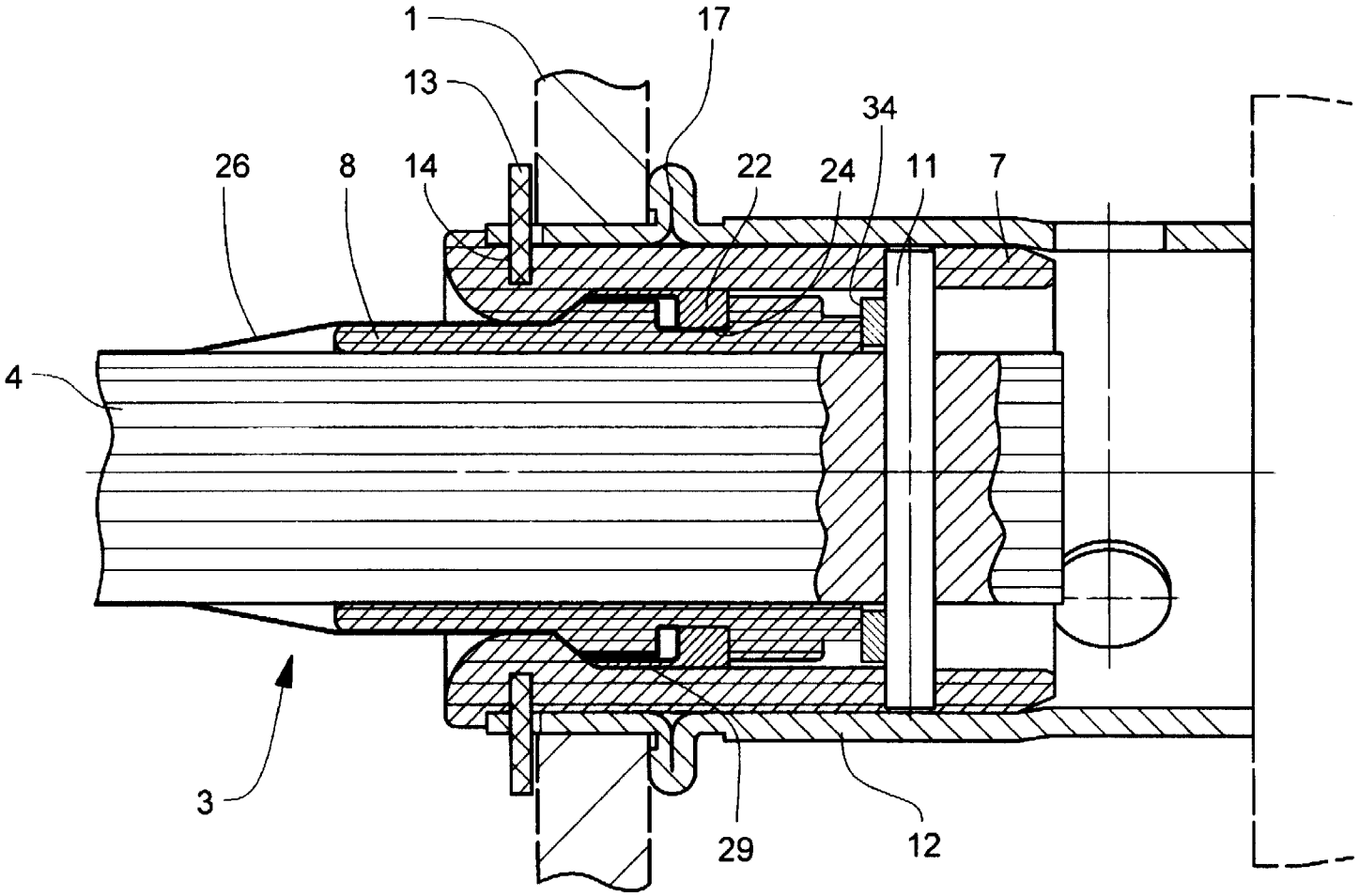
FIG. 4 is a section through a fastening of a filter sleeve in accordance with the invention with a drain element on the pressure plate of a fruit press.

Similar to FIG. 1, FIG. 4 shows the filter sleeve in its position mounted in the press, wherein the same reference numerals identify elements corresponding to each other. Only, instead of the known filter sleeve 6 of FIG. 1, a filter sleeve 26 as was already described in connection with FIG. 2, is represented in FIG. 4. No displacement of the shaped element 29 is possible in the course of the assembly of the filter sleeve 26 with the bead 22 on its end in the groove 24 of the cuff 8 and in the core holder 7. It is not possible with this embodiment to dislodge the filter sleeve 26 outward by pulling since it is firmly connected with the shaped element 29. In comparison with the known fastening in accordance with FIG. 1, mounting of the disk 34 and the transverse pin 11 is also simplified, since no filter end extends into the zone of these elements.

Figure 5:
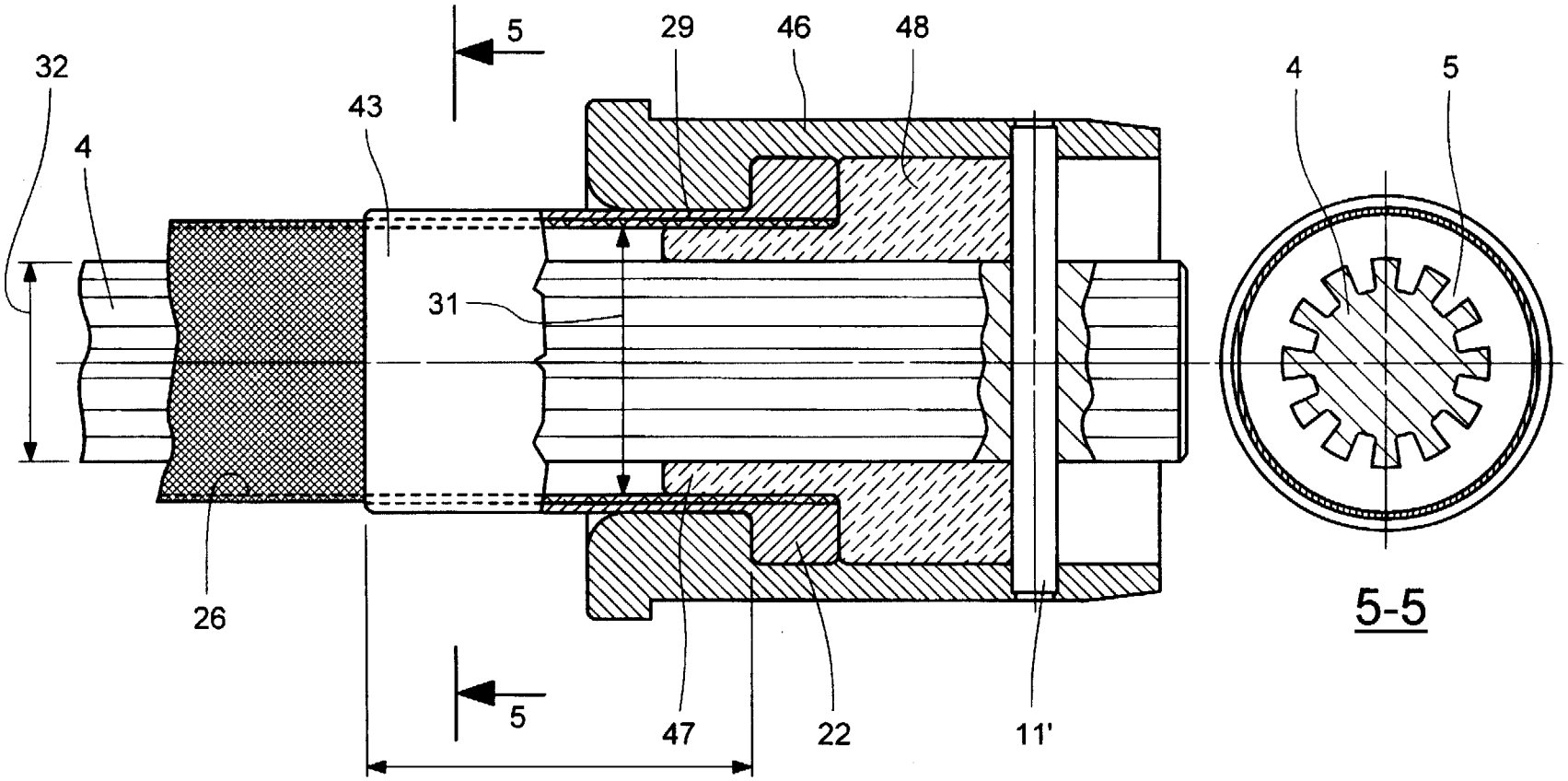
FIG. 5 is a section through a fastening of a further filter sleeve in accordance with the invention with a drain element by means of two sleeve-shaped components on the pressure plate of a fruit press.

The advantages of the invention are also present for filter sleeves whose diameter cannot be stretched. A holder in accordance with FIG. 5 is provided for such filter sleeves.

The rubber-elastically deformable ring-like shaped element 29 is extended here by an also rubber-elastic, hose-like extension 43, whose length is at least equal to the exterior diameter of the shaped element 29. The hose-like extension 43 is firmly connected over its entire length with the filter sleeve 26, the same as the shaped element 29 itself. The ring-like bead 22 of the shaped element 29 is larger here compared with the stretchable version. It is clamped between an outer sleeve 46 and an inner sleeve 48. The inner sleeve 48 as a rigid part takes the place of the elastic cuff 8 of FIG. 4. It has a neck 47 for supporting the end of the filter sleeve 26 from the inside and is axially fixed in place by a transverse pin 11' penetrating the outer sleeve 46 and the drain core 4.

It is important for the flawless functioning of the draining process that the inner diameter 31 of the filter sleeve 26 be considerably larger than the diameter 32 of the drain core 4. By means of this it is possible to prevent the shrinking of the filter sleeve 26 on the drain core, something which otherwise occurs. The hose-like extension 43 described in FIG. 5 is also advantageous in connection with the embodiments in accordance with FIG. 2 to FIG. 4. It can be made of an elastomer and in the area of its fastening on the filter sleeve 26 it prevents the latter's falling into the drain grooves 5 of the drain core 4 (see FIG. 1). It is therefore possible to form the neck 47 of the inner sleeve 48 relatively short and from a rigid plastic material.

Figure 6:
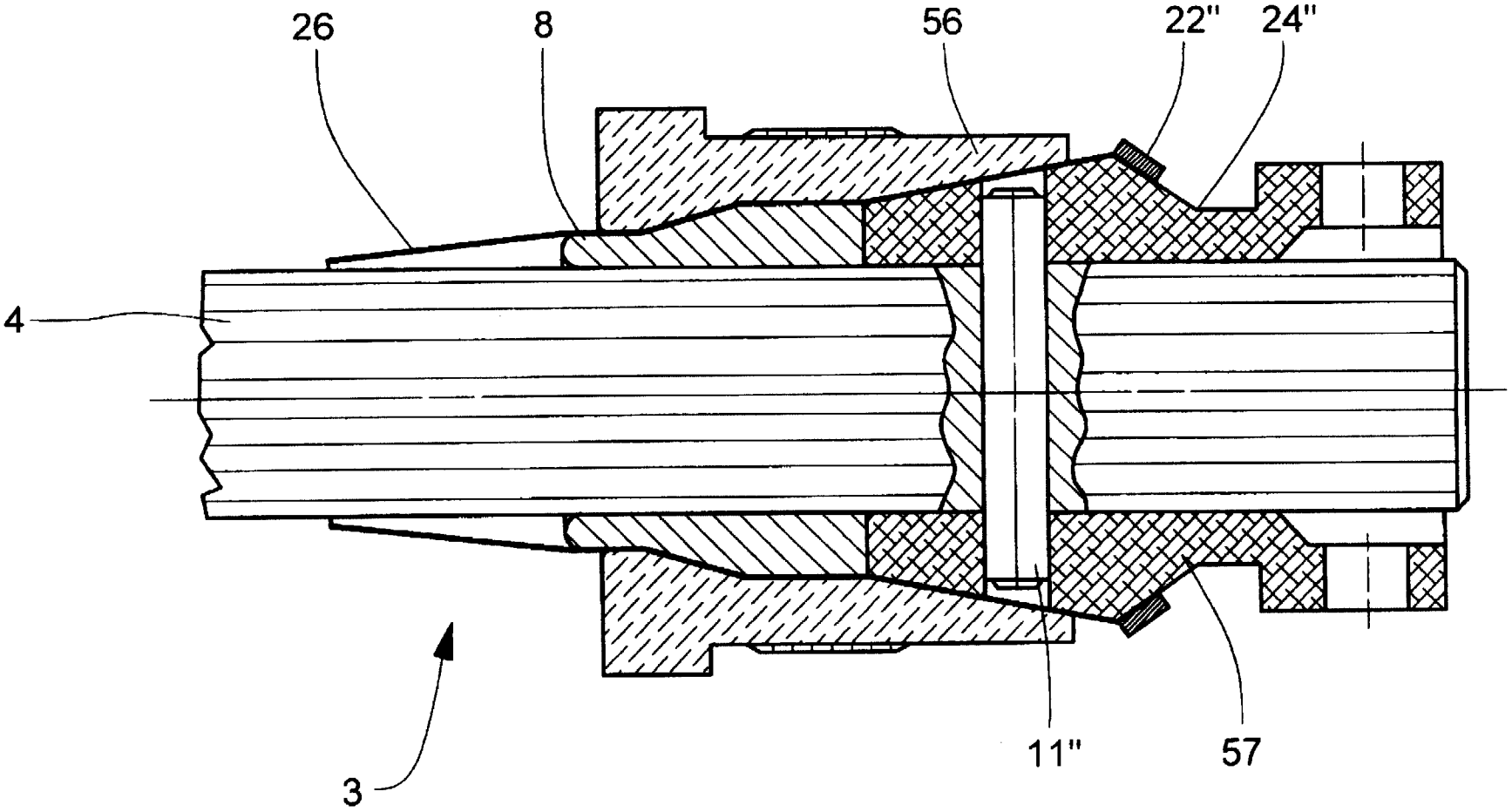
FIG. 6 is a section through a fastening of a stretchable filter sleeve in accordance with the invention with a layer of small thickness of drain elements on the pressure plate of a fruit press.

FIG. 6 represents an embodiment of the fastening of the filter sleeve 26, wherein it is clamped between an outer sleeve 56 and an inner cone 57, while the ring-shaped bead 22" remains free and because of its stretching enters a groove 24" of the cone 57. The outer sleeve 56 and the cone 57 are advantageously made of steel, and the bead 22" is a part of a coating of the end of the filter sleeve 26 consisting of an elastomer and whose thickness is small. With this embodiment of the filter sleeve 26 the prevention of runs and a clean filter end are also achieved.

What is claimed is:

1. A fruit press for removing juice from solid fruit comprising a pressing chamber; a plate member adjacent said chamber having an opening therein; a flexible core extending from within said chamber through said opening and having longitudinal grooves therein; an elastic sleeve enclosing a portion of said core located within said chamber and extending through said opening; an elastomeric ring fixedly cast to an end portion of said sleeve; a support body surrounding said core, said support body having an outer diameter greater than the inside diameter of said sleeve in the unstretched state of said sleeve and having a groove in its outer circumference; said sleeve and said elastomeric ring being stretchable to increase the diameter and circumference thereof to permit said end portion of said sleeve to be drawn over said support body far enough to cause said ring to enter said groove to fix said sleeve to said support body; and means for fixing said support body in position with respect to said opening in said plate member.

2. A fruit press according to claim 1, wherein said means for fixing said support body in position includes means for limiting movement of said support body axially of said core, and means fixed to said opening and closely surrounding said bead to confine said bead in said groove.

3. A fruit press according to claim 1, wherein said sleeve is knitted.

4. A fruit press according to claim 3, wherein said elastomeric material of said ring penetrates said knitted sleeve to fix said ring to said sleeve.

5. A filter assembly for use in a press for separating liquids from solids, comprising:

a tubular core holder;

a tubular cuff disposed at least partly within said tubular core holder, wherein said cuff includes an annular groove disposed in an outer peripheral surface thereof;

an elongate elastic drain element including an end portion disposed within said tubular cuff;

a filter sleeve including an end portion disposed at least partly between said tubular core holder and said tubular cuff, wherein the end portion of said filter sleeve includes a free end that extends into said annular groove; and a tubular element formed of an elastomeric material fixedly cast to a peripheral surface of the end portion of said filter sleeve, said tubular element including an annular bead portion substantially filling said annular groove.

6. A filter assembly according to claim 1, wherein said elastomeric material is molded on said filter sleeve.

7. A filter assembly according to claim 1, wherein said elastomeric material is coated on said filter sleeve.

8. A filter assembly according to claim 1, wherein said filter sleeve is a knitted material.

9. A filter assembly according to claim 8, wherein said elastomeric material is molded on an exterior surface of said filter sleeve.

10. A filter assembly according to claim 1, wherein said elastomeric material is cast to an exterior peripheral surface of said filter sleeve.

11. A filter assembly for use in a press for separating liquids from solids, comprising:

a tubular core holder;

a tubular cuff disposed at least partly within said tubular core holder, wherein said cuff includes an annular groove disposed in an outer peripheral surface thereof;

an elongate elastic drain element including an end portion disposed within said tubular cuff, a filter sleeve including an end portion disposed at least partly between said tubular core holder and said tubular cuff; and a tubular element formed of an elastomeric material fixedly cast an interior peripheral surface of the end portion of said filter sleeve and including an annular bead portion substantially filling said annular groove.

12. A filter assembly for use in a press for separating liquids from solids, comprising:

an outer sleeve including a radially inwardly extending flange at one end thereof;

an inner sleeve disposed at least partly within said outer sleeve, said inner sleeve including a radially outwardly extending annular flange at one end thereof;

an annular space disposed axially between the annular flanges of said outer sleeve and said inner sleeve;

an elongate elastic drain element including an end portion disposed within said inner sleeve;

a filter sleeve including an end portion disposed at least partly between said outer sleeve and said inner sleeve, wherein the end portion of said filter sleeve includes a free end that extends into said annular space; and a tubular element formed of an elastomeric material fixedly cast to an exterior peripheral surface of the end portion of said filter sleeve and including an annular bead portion substantially filling said annular space.

13. A filter assembly for use in a press for separating liquids from solids, comprising:

an outer sleeve;

a inner sleeve including an end portion disposed at least partly within said outer sleeve, wherein said inner sleeve includes an annular groove disposed in an outer peripheral surface thereof positioned outside of said outer sleeve;

an elongate elastic drain element including an end portion disposed within said inner sleeve;

a filter sleeve including an end portion disposed at least partly between said inner sleeve and said outer sleeve, wherein the end portion of said filter sleeve includes a free end that extends into said annular groove; and a tubular element formed of an elastomeric material fixedly cast on a peripheral surface of the end portion of said filter sleeve and surrounding a portion of said annular groove.

* * * * *